United States Patent [19]

Cooper et al.

[11] 4,199,642

[45] * Apr. 22, 1980

[54] LOW FLAME-RESPONSE POLYESTER FIBERFILL BLENDS

[75] Inventors: John L. Cooper, West Grove, Pa.; James A. Newnam, Hockessin, Del.

[73] Assignee: E. I. Du Pont de Nemours and Company, Wilmington, Del.

[ * ] Notice: The portion of the term of this patent subsequent to Aug. 9, 1994, has been disclaimed.

[21] Appl. No.: 794,225

[22] Filed: May 5, 1977

Related U.S. Application Data

[63] Continuation-in-part of Ser. No. 671,278, Mar. 29, 1966, Pat. No. 4,040,371.

[30] Foreign Application Priority Data

Mar. 25, 1977 [CA] Canada ..... 274818

[51] Int. Cl.[2] ..... D02G 3/00; D04H 1/58

[52] U.S. Cl. ..... 428/288; 428/378; 428/391; 428/395; 428/921

[58] Field of Search ..... 428/375, 395, 378, 391, 428/359, 360, 288, 361, 362, 920

[56] References Cited

U.S. PATENT DOCUMENTS

| | | | |
|---|---|---|---|
| B 378,760 | 3/1976 | Economy et al. | 428/224 |
| 3,271,189 | 9/1966 | Hofmann | 428/361 |
| 3,454,422 | 7/1969 | Mead et al. | 428/361 |
| 3,628,995 | 12/1971 | Economy et al. | 428/359 |
| 3,639,154 | 2/1972 | Sawa et al. | 428/395 |
| 3,660,222 | 5/1972 | Fleming, Jr. et al. | 428/302 |
| 3,702,260 | 11/1972 | Jayne et al. | 428/361 |
| 3,870,590 | 3/1975 | Hurwitz | 57/140 BY |
| 4,001,477 | 1/1977 | Economy et al. | 428/224 |
| 4,054,695 | 10/1977 | Johnson | 428/395 |
| 4,062,999 | 12/1977 | Kondo et al. | 428/395 |

FOREIGN PATENT DOCUMENTS

| | | |
|---|---|---|
| 943014 | 3/1974 | Canada . |
| 1936712 | 3/1970 | Fed. Rep. of Germany . |
| 2117999 | 11/1971 | Fed. Rep. of Germany . |
| 1130287 | 10/1968 | United Kingdom . |
| 1311256 | 3/1973 | United Kingdom . |

OTHER PUBLICATIONS

Swihart et al., Textile Chemists and Colorist, 6 (5), pp. 32–35, (1974).

*Primary Examiner*—Lorraine T. Kendell

[57] ABSTRACT

The horizontal burning rate of polyester fiberfill coated with cured polysiloxane and/or bonded with a synthetic resin is reduced by incorporating small amounts (2 to 20% by weight) of a synthetic organic filamentary material that maintains its physical integrity when exposed to a small flame. The preferred material is poly(p-phenylene terephthalamide). This has particular application to silicone-slickened polyester staple fibers used for fiberfill, and articles therefrom, but has application also to silicone-slickened polyester filler tow, to resin-bonded polyester staple fiber batts, whether silicone-slickened or not, and to resin-bonded polyester filler tow.

16 Claims, No Drawings

LOW FLAME-RESPONSE POLYESTER FIBERFILL BLENDS

CROSS-REFERENCE TO RELATED APPLICATION

This application is a continuation-in-part of application Ser. No. 671,278, filed Mar. 29, 1976, now U.S. Pat. No. 4,040,371.

BACKGROUND OF THE INVENTION

This invention concerns improvements in and relating to polyester fiber filling material, commonly referred to as polyester fiberfill, and more particularly to improvements in the resistance to burning of such material and of articles, such as batts, quilted composites, fabrics, garments and other articles made therefrom.

Polyester fiberfill is used commercially in many garments and other articles, such as sleeping bags, comforters and pillows. A particularly useful and desirable form of polyester fiberfill has a coating of cured polysiloxane, e.g. as disclosed in Hofmann U.S. Pat. No. 3,271,189 and Mead et al. U.S. Pat. No. 3,454,422, because certain desirable properties, such as bulk stability and fluffability are improved thereby. Most polyester fiberfill has been in the form of staple fibers, but, more recently, tows of continuous filaments have been proposed and used, e.g. as described by V. Altvatter in Chemiefasern-/Textil Ind. 23 (February 1973), 117–118. Some polyester fiberfill products are used in the form of a resin-bonded batt, as mentioned by P. J. Kline in Textile Chemist and Colorist, Volume 8 (1976), pages 35–37. The resin bonding agent is sprayed onto the fiberfill, e.g. in the form of batts of staple fibers, and provides an advantageous means of increasing the cohesion of the batts. These resin-bonded polyester batts, containing relatively small amounts of cured resin (generally less than 20% by weight) are to be contrasted with impregnated fiber batts containing much more resin, e.g. for use as artificial leather.

T. J. Swihart and P. E. Campbell have reported that silicone coatings increase the flammability of polyester filamentary materials in an article entitled "How Silicones Affect Fabric Flammability", in Textile Chemist and Colorist, Volume 6 (1974) pages 109–112. Similarly, P. J. Kline has reported that resin-bonding increases the flammability of polyester fiberfill. The object of the present invention has been to reduce the horizontal burning rate of such polyester fiberfill when subjected to a small flame (such as a candle or burning twig, to which articles such as sleeping bags may be exposed), without losing the desirable properties brought about by the use of the polysiloxane coating and/or the resin bonding agent.

A recent suggestion for improving the flame-resistance of polyester fiberfill has been to coat or bond a mixture of 65 to 95% polyester and 5 to 35% of non-flammable halogen-containing polymer with a specific non-flammable halogen-containing copolymer containing up to 10% of flame-retardant halogen-containing synergist in Hurwitz U.S. Pat. No. 3,870,590 (also reported by P. J. Kline). Hurwitz warns against the use of large amounts of halogen-containing polymers in fiberfill because of the severe loss of resilience and the tendency to pack down in use. He notes that, although expensive flameproof fibers are available and have been blended with flammable fibers in an attempt to obtain less expensive textile products having non-flammable properties, the products obtained from such a mixture of polyester fibers still have deficiencies making them unsuitable for many uses if the proportion of non-flammable fibers content is high enough to make the product self-extinguishing.

Generally, the addition of small amounts of flame-resistant fibers to batts of polyester staple fibers (that have not been coated with silicone or resin-bonded) has increased the horizontal burning rate of the batts.

It was very surprising, therefore, to find that a significant reduction in the horizontal burning rate of polysiloxane-coated and/or resin-bonded polyester fiberfill could be achieved without significant loss of desirable characteristics merely by incorporating relatively small amounts of certain other filamentary materials.

SUMMARY OF THE INVENTION

There is, therefore, now provided an intimate blend in which, by weight, about 80 to 98% is polyester fiberfill and about 2 to 20% is synthetic organic filamentary material that maintains its physical integrity when exposed to the flame from a burning match, wherein the polyester has a cured polysiloxane coating and/or has been bonded with a synthetic resin bonding agent, and articles, such as batts, quilted composites, fabrics, garments and other articles made from such blends.

DETAILED DESCRIPTION OF THE INVENTION

The polyester may be any of the polyesters suitable for preparing textile fibers but will preferably be a terephthalate polyester such as poly(ethylene terephthalate), poly(hexahydro-p-xylylene terephthalate) and terephthalate copolyesters in which at least 85 mole percent of the ester units are ethylene terephthalate or hexahydro-p-xlylene terephthalate units. The polyester fiberfill is made by conventional techniques and may be in the form of staple fibers, which are more common at this time, or continuous filament tows. Such tows generally contain large numbers of filaments, being preferably of denier 100,000 or more, it being understood that the present invention is concerned only with polyester filling material, and not with blended yarns.

Suitable polysiloxane compositions for use in preparing the cured polysiloxane-coated polyester fiberfill are, e.g., those described in U.S. Pat. Nos. 3,454,422 and 3,271,189, referred to hereinbefore. Some suitable resin binders are mentioned by P. J. Kline, in U.S. Pat. Nos. 3,402,070 and 3,660,222, and in the Examples. There are several proprietary materials specifically designed for these purposes.

The amounts of cured polysiloxane and/or resin binder will vary according to the intended use. For instance, the amount of cured polysiloxane on the polyester fiberfill may range from 0.01% to 5% and preferably will be from about 0.1% to about 1.5% by weight, based on the polyester fiberfill. It is generally preferred to apply the polysiloxane to the polyester before blending with the other filamentary material. The amount of resin binder (after curing) may range up to about 20%, and generally from about 5% to about 20%, preferably from about 10% to about 15% by weight, based on the blend. The resin, in the form of an emulsion, may be applied by spraying onto a batt of the blend, followed by curing.

The synthetic organic filamentary material that is blended with the polyester fiberfill comprises those synthetic organic filamentary materials that maintain their physical integrity, that is, do not, for example, melt, vaporize, shrink excessively or burn and crumble, after being exposed to a small flame such as a burning match applied to a loose mass of the fibers in an ash tray. As suitable materials, there may be mentioned poly(p-phenylene terephthalamide), which is preferred, flame retardant rayon, novolac resins, poly(benzimidazole), and poly(m-phenylene isophthalamide). If desired, two or more types may be present in the blend, and a mixture of poly(p-phenylene terephthalamide) and poly(m-phenylene isophthalamide) has given an especially good result. Some of these materials are accepted as having a high resistance to flammability, but this is not the important criterion. Non-flammable halogen-containing polymers such as are disclosed in U.S. Pat. No. 3,870,590 lose their physical integrity by melting or shrinking away when exposed to a small flame, and are therefore unsuitable. On the other hand, flammable materials may be suitable, despite the fact that they burn, if, for example, they form a residual ash that preserves its physical integrity. It is possible to test filamentary materials empirically, e.g. by studying the effect of a small flame on the physical integrity of a loose ball thereof, to receive guidance as to their suitability, and it is also possible to test the burning rate of blends as described hereinafter.

The amount of such synthetic organic filamentary material present in the blend will range from about 2% to about 20%, and is preferably 5 to 15% by weight and especially about 10% by weight.

Preferably, the synthetic organic filamentary material will be in the same form as the polyester fiberfill, i.e. polyester staple fibers are preferably blended with synthetic organic staple fibers that maintain their physical integrity when exposed to the flame from a burning match, and continuous filamentary tows of polyester are preferably blended with continuous filaments of the synthetic organic filamentary material.

The blends, batts, quilted composites, fabrics, garments and other articles may be made by conventional techniques.

The flame response of the blends is determined by preparing a composite structure which simulates a filled product and exposing it to a small flame source and measuring its horizontal rate of burn. Substantial reductions in rate of burn represent a reduced hazard to a person using a sleeping bag or similar article which might be exposed to a small flame source and experience a horizontal propagating flame front. It was not expected that such relatively small amounts of the synthetic organic filamentary material that maintains its physical integrity when exposed to the flame would provide the highly desired reduction in burn rate in composites of coated and/or bonded polyester fiberfill. It should be understood that the nature of other ingredients of such composites, especially the cover fabric, has an important effect.

In the following Examples, all percentages are by weight, based on total weight, unless specified to the contrary. The horizontal burning rate test described below follows the procedure adopted by the Canvas Products Association International in CPAI-75, a rate-of-burn standard for sleeping bags.

EXAMPLE 1

Drawn, hollow, crimped 4.75 denier per filament staple fibers of poly(ethylene terephthalate) having a cured polysiloxane coating are combined with other fibers in the amounts indicated in Table 1 in approximately one kilogram lots and are blended by hand and then through a garnett (1953 Proctor & Schwartz Garnett Card) to produce intimately blended webs that are cross-lapped into batts of area 32 square feet (3 square meters) and weighing about one ounce per square foot (300 grams per square meter).

These batts are cut into 12-inch by 28-inch pieces (30.5 cm by 71.2 cm), and fabricated into a composite structure with the batting between two 12-inch by 28-inch (30.5 cm by 71.2 cm) pieces of downproof nylon taffeta fabric made from 70 denier filament yarns. These composite structures are sewn using spun polyester 70/3 thread (3 yarns each of 70 denier, Coates & Clark "Flame Safe"), ten stitches per inch (4 stitches per cm) lockstitch with ¼ inch (0.6 cm) seam allowance on all four edges.

The composite structures are compressed in a chamber to ½ their original height for 24 hours. Five replicates are compressed in the same chamber at the same time. Compressed specimens are allowed to passively recover for at least one hour prior to testing for rate of horizontal burn.

Burn tests are conducted in a test cabinet situated in a sealed chemical hood equipped with a variable speed fan; pressure in the hood is 0.65 inch (1.65 cm) of water below atmospheric pressure. During ignition, a 140 foot (43 meter) per minute air flow is maintained outside the test cabinet. At test completion, a 1350 foot (415 meter) per minute air flow is used to clear the hood of volatile combustion products.

The rectangular test cabinet used is approximately 24 inches by 24 inches by 28 inches high (61 cm by 61 cm by 71 cm). There is a 2-inch (5.1-cm) air gap at the top and bottom of both the two metal sides and the metal back. The front is a 20-inch square (51-cm) sheet of a heat resistant glass with a 4-inch (10-cm) gap at both top and bottom. The top is a solid metal plate.

For burn testing, each of the composite specimens is folded in half once to 12 by 14 inches (30 by 36 cm) and placed on a rectangular steel plate of similar overall dimensions having a section of length 10 inches by 1½ inches in depth (25.4 cm×3.8 cm) cut from the front edge of length 12 inches (30 cm). The side and back edges of the specimen are compressed to one inch (2.5 cm) thickness with a steel clamp. The plate, with clamp and folded specimen, is supported on four legs that allow placement of a Bunsen burner beneath the center of the folded specimen edge protruding at the front. A flow of n-butane gas, unmixed with air, is adjusted to give the burner a flame which rises ¾ of an inch (1.9 cm) above the top of the steel plate and impinges on the specimen. The flame is applied for 30 seconds.

After the specimen has been ignited and has burned 1½ inches (3.8 cm) along its long dimension, a stopwatch is started. After the specimen has burned an additional 10 inches (25.4 cm) along the long dimension, the watch is stopped and the elapsed time in seconds recorded and used to calculate the rate of horizontal burn. The parting of two cotton threads with attached weights suspended across the top of the specimen 1½ and 11½ inches (3.8 and 29.2 cm) from and parallel to the front edge indicates when the stopwatch should be operated. If the first thread has not parted by the time all flames have disappeared, the specimen is considered as not ignited, i.e. there is a zero burn time and a zero burn distance. If the first thread has parted but the second thread has not parted by the time all flames have disappeared, the sample is considered as self-extinguished and the time from the parting of the first thread to the last flame going out is recorded and the distance burnt from the first thread toward the second thread is recorded.

After all five replicate specimens in a given set have been tested, the product of 60 times the sum of the five burn distances is divided by the sum of the five burn times. The result of this calculation is the average horizontal rate of burn in inches per minute for the sample set.

Table 1 shows the nature and amounts of the organic staple fibers used in these polysiloxane-coated polyester blends and the horizontal burn rates of these samples, such rates being at most only about half that of the polysiloxane-coated polyester control. It will be noted that the burn rate is decreased by the addition of more of the minor component. The nature of the nylon taffeta cover, however, has a limiting effect on further reduction of the burning rate of blends beyond a certain point, and it is then desirable to select a more flame-resistant cover.

In addition to the foregoing polysiloxane-coated polyester blends, a similar reduction in burning rate has been noted for composites comprising other polysiloxane-coated polyester fibers, namely such fibers of poly(-hexahydro-p-xylylene terephthalate) and of a copolyester, and using a different polysiloxane coating, and using poly(benzimidazole) as the minor component. Although the fibers of the samples tested in Example 1 had a cured polysiloxane coating in amount about 0.75%, based on the weight of the fiber, we have tested samples having differing amounts of such coating, and observed a similar reduction in burning rate.

TABLE 1

| Sample | Minor Component | Amount % | Burn Rates inches/min. | (cm/min) |
|---|---|---|---|---|
| Control | — | 0 | 4.5 | (11.4) |
| 1 | MPD-I | 10 | 2.4 | (6.1) |
| 2 | PPD-T | 2 | 1.9 | (4.8) |
| 3 | Novolac | 10 | 1.8 | (4.6) |
| 4 | PFR rayon | 10 | 1.6 | (4.1) |
| 5 | PFR rayon | 13 | 1.5 | (3.8) |
| 6 | PPD-T | 10 | 1.5 | (3.8) |
| 7 | PPD-T 50/50 | 13 | 1.3 | (3.3) |
| 8 | PPD-T/PFR rayon | 13 | 1.3 | (3.3) |
| 9 | 95/5 MPD-I/PPD-T | 10 | 1.0 | (2.5) |

Note: MPD-I is poly(m-phenylene isophthalamide). PPD-T is poly(p-phenylene terephthalamide). The novolac fiber is sold under the tradename "Kynol" by Carborundum Corporation. PFR is a flame retardant rayon sold by FMC Corporation.

EXAMPLE 2

The procedure of Example 1 is followed so as to combine the amounts of PPD-T indicated in Table 2 with drawn, hollow, crimped 4.75 denier per filament staple fibers of poly(ethylene terephthalate) (without any cured polysiloxane coating), and form pieces of cross-lapped batts of the same dimensions as in Example 1. These pieces are then sprayed on both sides with an aqueous emulsion of a commercial acrylic resin binder sold by Rohm & Haas under the trade name Rhoplex® TR-407 to a 20% resin loading, based on the weight of the resin solids added (after curing) as compared to the weight of the blended fibers before spraying, and cured in an oven at about 175° C. to constant weight. The horizontal burn rates are measured as in Example 1, and are given in Table 2, and compared with a control containing no PPD-T, and show a similar significant decrease when small amounts of PPD-T are incorporated into the resin-bonded batt.

TABLE 2

| PPD-T | Burn Rates - inches/min (cm/min) |
|---|---|
| 0 Control | 4.0 (10) |
| 2 | 2.9 (7.3) |
| 5 | 2.3 (5.9) |
| 10 | 1.9 (4.8) |
| 15 | 1.8 (4.6) |
| 20 | 1.6 (4.1) |

EXAMPLE 3

The procedure of Example 2 is followed, except that the weights of TR-407 acrylic resin indicated in Table 3 are sprayed onto the polyester staple fibers, and the amount of PPD-T is always 10%.

TABLE 3

| Resin % | Burn Rates - inches/min (cm/min) |
|---|---|
| 0 | 1.6 (4.1) |
| 5 | 1.5 (3.8) |
| 10 | 1.6 (4.1) |
| 20 | 1.9 (4.8) |
| 40 | 1.6 (4.1) |

Thus the amount of resin-bonding agent does not materially affect the horizontal burning rate, provided the PPD-T is present to reduce the flammability.

EXAMPLE 4

The procedure of Example 3 is followed, except that 10% of different commercial resins are used, as indicated in Table 4, some results being the average of 3 replicate specimens.

TABLE 4

| Resin | Burn Rates - inches/min (cm/min) Control | 10% PPD-T |
|---|---|---|
| Rhoplex® TR-407 acrylic | 4.0 (10) | 1.9 (4.8) |
| Rhoplex® HA8 acrylic | 3.1 (7.6) | 1.7 (4.3) |
| UCAR® 828 vinyl acrylic | 2.3 (5.9) | 1.6 (4.1) |
| Geon® 590 × 4 pvc | 1.6 (4.1) | SE |

Rhoplex® TR-407 and HA8 are proprietary self-crosslinking acrylic resin emulsions sold by Rohm & Haas (the resins differ in softening point, HA8 having a lower softening temperature), UCAR® Latex 828 is a proprietary self-crosslinking vinyl acrylic resin sold by Union Carbide, and Geon® Latex 590×4 is a proprietary water dispersion of a modified vinyl chloride polymer, ester-plasticized, sold by B. F. Goodrich. "SE" indicates that all the specimens containing 10% PPD-T and sprayed with Geon® 590×4 pvc self-extinguished after initial ignition (burning only an average 1.2 inches (3 cm)/min), whereas the respective controls burned slowly and did not self-extinguish.

It should be noted that a significant improvement was achieved by the addition of 10% PPD-T for all these binders.

EXAMPLE 5

A commercial batt of acrylic resin-bonded solid (as opposed to hollow), crimped 6 denier per filament continuous filament poly(ethylene terephthalate), sold under the tradename "PolarGuard" by Celanese Corporation, was combined by hand with 10% by weight of uncrimped continuous PPD-T filaments, and the batt was then cut, formed into composite structures and tested as in Example I, which were compared with structures similarly made from a control batt containing no PPD-T, to show a significant reduction in burning rate, as indicated in Table 5.

TABLE 5

| Sample | Burn Rate inches/min | (cm/min) |
|---|---|---|
| Control 0% PPD-T | 3.9 | (9.9) |
| 10% PPD-T | 1.9 | (4.8) |

Such a resin-bonded tow of continuous polyester fiberfill containing continuous filaments of a synthetic organic filamentary material to reduce its burning rate is particularly advantageous, and is an important aspect of the invention.

We claim:

1. An intimate blend comprising, by weight, about 80 to 98% of polyester fiberfill and about 2 to 20% of synthetic organic filamentary material that maintains its physical integrity when exposed to the flame from a burning match, wherein the polyester has a cured polysiloxane coating.

2. A blend according to claim 1, wherein the said synthetic organic filamentary material is poly(p-phenylene terephthalamide).

3. A blend according to claim 1, wherein the polyester fiberfill and the said organic filamentary material are in the form of a tow of continuous filaments.

4. A blend according to claim 3, wherein the said synthetic organic filamentary material is flame-retardant rayon.

5. A blend according to claim 3, wherein the said synthetic organic filamentary material is a phenolic fiber of a novolac resin.

6. A blend according to claim 3, wherein the said synthetic organic filamentary material is poly(m-phenylene isophthalamide).

7. A blend according to claim 1, wherein the said synthetic organic filamentary material is poly(benzimidazole).

8. A batt comprising a blend according to claim 1.

9. A batt according to claim 8, wherein the blend has been bonded with a synthetic resin bonding agent.

10. A batt comprising an intimate blend of, by weight, about 80 to 98% of polyester fiberfill and about 2 to 20% of synthetic organic filamentary material that maintains its physical integrity when exposed to the flame from a burning match, wherein the batt has been bonded with a synthetic resin bonding agent.

11. A batt according to claim 10, wherein the said synthetic organic filamentary material is poly(p-phenylene terephthalamide).

12. A batt according to claim 10, wherein the said synthetic organic filamentary material is flame-retardant rayon.

13. A batt according to claim 10, wherein the said synthetic organic filamentary material is a phenolic fiber of a novolac resin.

14. A batt according to claim 10, wherein the said synthetic organic filamentary material is poly(m-phenylene isophthalamide).

15. A batt according to claim 10, wherein the said synthetic organic filamentary material is poly(benzimidazole).

16. A batt according to claim 10, wherein the polyester fiberfill and the said organic filamentary material are in the form of a tow of continuous filaments.

* * * * *

UNITED STATES PATENT OFFICE
CERTIFICATE OF CORRECTION

PATENT NO. : 4,199,642

DATED : April 22, 1980

INVENTOR(S) : John L. Cooper and James A. Newnam

It is certified that error appears in the above-identified patent and that said Letters Patent are hereby corrected as shown below:

Column 7, line 28 (first line of Claim 2) "Claim 1" should read -- Claim 3 --.

Column 8, line 11, "wherein the blend" should read -- wherein the batt --.

Signed and Sealed this

*Twenty-first* Day of *October 1980*

[SEAL]

*Attest:*

SIDNEY A. DIAMOND

*Attesting Officer*

*Commissioner of Patents and Trademarks*